US006972729B2

(12) United States Patent
Wang

(10) Patent No.: US 6,972,729 B2
(45) Date of Patent: Dec. 6, 2005

(54) BROADBAND/MULTI-BAND CIRCULAR ARRAY ANTENNA

(75) Inventor: Johnson J. H. Wang, Marietta, GA (US)

(73) Assignee: Wang Electro-Opto Corporation, Marietta, GA (US)

( * ) Notice: Subject to any disclaimer, the term of this patent is extended or adjusted under 35 U.S.C. 154(b) by 46 days.

(21) Appl. No.: 10/811,721

(22) Filed: Mar. 29, 2004

(65) Prior Publication Data

US 2004/0257292 A1 Dec. 23, 2004

Related U.S. Application Data

(60) Provisional application No. 60/480,384, filed on Jun. 20, 2003.

(51) Int. Cl.[7] ..... H01Q 19/00
(52) U.S. Cl. ..... 343/833; 343/834
(58) Field of Search ..... 343/729, 731, 343/829, 830, 833, 834, 846

(56) References Cited

U.S. PATENT DOCUMENTS

| | | | | |
|---|---|---|---|---|
| 1,860,123 A | | 5/1932 | Hidetsugu | |
| 2,473,421 A | * | 6/1949 | Fubini et al. | 343/761 |
| 3,560,978 A | | 2/1971 | Himmel et al. | 343/106 |
| 3,846,799 A | | 11/1974 | Gueguen | 343/833 |
| 4,370,657 A | * | 1/1983 | Kaloi | 343/700 MS |
| 4,631,546 A | | 12/1986 | Dumas et al. | 343/833 |
| 4,700,197 A | | 10/1987 | Milne | 343/837 |
| 5,008,681 A | * | 4/1991 | Cavallaro et al. | 343/700 MS |
| 5,220,335 A | * | 6/1993 | Huang | 343/700 MS |
| 5,767,807 A | | 6/1998 | Pritchett | 342/374 |
| 6,049,310 A | | 4/2000 | Sadahiro | 343/702 |
| 6,407,719 B1 | | 6/2002 | Ohira et al. | 343/893 |
| 6,456,249 B1 | * | 9/2002 | Johnson et al. | 343/702 |
| 6,515,635 B2 | | 2/2003 | Chiang et al. | 343/834 |
| 6,759,986 B1 | * | 7/2004 | Anderson et al. | 343/700 MS |

OTHER PUBLICATIONS

Article entitled "The Use of a Ring Array as a Skip Range Antenna*" by Tillman, et al., original manuscript received Jun. 17, 1955, revised manuscript received Aug. 8, 1955, Tillman, Patton, Blakely, and Schultz: Skip Range Antenna, pp. 1655-1660.
Article entitled "Parasitic Excitation of Circular Antenna Arrays*" by Simpson, et al., dated May 1961, pp. 263-267.
Article entitled "IEEE Transactions on Antennas and Propagation" by Ruben Das; dated May 1966, pp. 398-400.
Article entitled "Electronically Scanned TACAN Antenna" by Edward J. Christopher, IEEE Transactions on Antennas and Propagation, vol. AP-22, No. 1, Jan. 1974, pp. 12-16.
Article entitled "Reactively Controlled Directive Arrays" by Roger F. Harrington, IEEE Transactions on Antennas and Propagation, vol. AP-26, No. 3, May 1978, pp. 390-395.

(Continued)

*Primary Examiner*—Shih-Chao Chen
(74) *Attorney, Agent, or Firm*—Thomas, Kayden, Horstemeyer & Risley LLP

(57) ABSTRACT

A broadband/multiband circular array antenna is disclosed. One embodiment comprises a circular directional array antenna comprising a driven omnidirectional traveling-wave antenna element coupled to a transceiver via a feed and a plurality of surface-waveguide elements symmetrically positioned about and spaced from the driven omnidirectional traveling-wave antenna element. Each surface-waveguide element receives a control signal configured to selectively alter its waveguide characteristics to electronically direct a beam to/from the array. The array provides a directionally controllable antenna beam with broadband/multiband frequency performance in a low profile design that is both economical and practical to produce and maintain.

14 Claims, 10 Drawing Sheets

OTHER PUBLICATIONS

Article entitled "Properties and Applications of the Large Circular Resonant Dipole Array" by King, et al., IEEE Transactions on Antennas and Propagation, vol. 51, No. 1, Jan. 2003, pp. 103-109.

Article entitled "A Microwave Beacon and Guiding Signals for Airports and Their Approaches" by Ronold W.P. King, IEEE Transactions on Antennas and Propagation, vol. 51, No. 1, Jan. 2003, pp. 110-114.

* cited by examiner 5 dB/division 1.525 GHz 1.435 GHz 1.480 GHz 1.500 GHz 1.525 GHz 2.200 GHz 2.240 GHz 2.265 GHz 2.295 GHz 2.390 GHz 1.435 GHz 1.480 GHz 1.500 GHz 1.525 GHz 2.200 GHz 2.240 GHz 2.265 GHz 2.295 GHz 2.390 GHz 5 dB/division

BROADBAND/MULTI-BAND CIRCULAR ARRAY ANTENNA

CROSS-REFERENCE TO RELATED APPLICATION

This application claims priority to U.S. provisional application entitled, "Broadband/Multiband Circular Array Antenna," having Ser. No. 60/480,384, filed Jun. 20, 2003, which is entirely incorporated herein by reference.

STATEMENT REGARDING FEDERALLY SPONSORED RESEARCH OR DEVELOPMENT

The U.S. government has a paid-up license in this invention and the right in limited circumstances to require the patent owner to license others on reasonable terms as provided for by the terms of F04611-01-C-0008 awarded by the Air Force Flight Test Center, Edwards AFB, California 93524.

TECHNICAL FIELD

The present invention is generally related to radio-frequency antennas and more particularly, circular array antennas having a directional beam for omnidirectional coverage.

BACKGROUND

The array antenna is a class of antenna that employs multiple element antennas to form a fixed or steered directional beam to perform essential functions in wireless telecommunications, radar, navigation, guidance, electronic warfare, etc. Array antennas that can both transmit and receive can be classified as: (1) phased array antennas in which every element is connected to the transmitter/receiver via a network to achieve a certain amplitude and phase distribution needed for beam forming; (2) switched-element array antennas, which achieve beam shaping and beam steering by turning on or off certain elements; (3) Yagi-Uda array antennas in which most array elements are parasitically coupled to one or a few driven elements.

Existing array antennas are predominately of the first two types, i.e., phased arrays and switched-beam arrays, and in particular linear and planar phased arrays. Unfortunately, phased array and switched-beam array antennas are expensive, bulky, and complex as compared with the Yagi-Uda array antennas. As a result, as pointed out by King et al. (R. W. P. King, M. Owens, and T. T. Wu, "Properties and applications of the large circular resonant dipole array," *IEEE Transactions on Antennas and Propagation*, Vol. 51, No. 1, pp. 103–109, January 2003), perhaps the most useful array antenna is the Yagi-Uda array antenna. The Yagi-Uda antenna, invented eight decades ago (H. Yagi and S. Uda, "Projector of the sharpest beam of electric waves," *Proc. Imperial Academy of Japan*, Vol. 2, p. 49, Tokyo, 1926), has gone through considerable development to evolve into a variety of forms and functionalities.

The class of Yagi-Uda array, as exemplified in a linear array 10 shown in FIG. 1, consists of n dipole elements, which include a driven element 11 connected with the transmitter and/or receiver, as well as a parasitically excited reflector 12 and (n−2) directors 13. Reflector 12 and directors 13 are positioned to reflect and reinforce, respectively, the electromagnetic wave emitted from the driven element 11 by parasitic resonance action, resulting in a beam in the direction of the Z-axis with polarization parallel to the X-axis. The usefulness of the Yagi-Uda array is due to its low cost, lightweight, and low wind resistance. Familiar applications include VHF/UHF antennas for television as well as other broadcasts and communications.

The circular Yagi-Uda array was first envisioned in the patent application of Yagi filed as far back as 1926 (U.S. Pat. No. 1,860,123, issued May 24, 1932). As shown in FIG. 2, a circular array 20 comprises a driven element 21 at the center (i.e., the origin of the rectangular X-Y-Z coordinates) and multiple parasitically excited elements 25 on the X-Y plane about the Z-axis. Parasitically excited elements 25 are located along a circle having a radius, r, of about ¼λ, where λ denotes the operating wavelength. The driven element 21 and the parasitically excited elements 25 are arranged in a direction substantially parallel to the Z-axis to have a substantially similar polarization. Additional concentric rings of parasitic elements at radii of ½λ, ¾λ, etc. were also indicated in the Yagi patent. By controlling the parasitic elements 25, a beam can be formed in the X-Y plane and electronically steered about the Z-axis.

In the early 1970s when the need for low-cost arrays arose and the practical advantages of the Yagi-Uda array were amply demonstrated, engineers began to investigate circular Yagi-Uda arrays. Unfortunately, the efforts in developing circular Yagi-Uda arrays have been much less successful than those for the linear Yagi-Uda arrays and engineers invariably employed monopole antennas as the array elements, as shown in FIG. 3. A circular array 30 comprises a driven monopole element 31 at the center and multiple parasitically excited monopole elements 35 located along a circle centered at the driven monopole element 31. The parasitically excited elements 35 are monopoles on top of a conducting ground plane 32. Electronic beam steering is achieved by varying the individual input impedance of the parasitic elements 35.

Early linear Yagi-Uda array antennas in the 1920s had a very narrow bandwidth of less than 1%. It was only a gradual shift in the design methodology from the concept of linear parasitic resonance arrays to the concept of traveling wave antennas that led to the enhancement of bandwidth to 10%, 20%, and 100% over the following decades, and finally to over 1000% in the 1960s.

Similarly, prior-art approaches for circular Yagi-Uda arrays have been predominantly based on the concept of resonance between driven and parasitic array elements as well as lumped-element circuits to control the RF impedance, thus the beam.

These prior-art approaches result in antennas limited in their operational frequency and bandwidth. The antennas are narrow-banded, a limitation rooted in the inherently narrow-band resonance mechanism employed for the parasitic electromagnetic coupling in these designs. The resonance mechanism is sensitive to the location and length of these element antennas in terms of the operating wavelength (λ), thus making the array narrow-band. These prior-art techniques are also handicapped by their circuit-based design approaches for the antenna structure. Thus, prior-art antenna designs are not practical or even applicable at frequencies above UHF (ultra-high frequency—from 300 MHz to about 1 GHz), where wave phenomena become manifest and prominent. The use of resonant monopoles for both driven and parasitic elements also leads to an undesirably high profile for the array.

SUMMARY

One embodiment is a broadband/multiband circular directional array antenna comprising a driven omnidirectional traveling-wave antenna element coupled to a transceiver via a feed network and a plurality of surface-waveguide elements concentrically and symmetrically positioned about and spaced from the driven omnidirectional traveling-wave antenna element. The surface-waveguide elements are configured to receive control signals configured to alter surface-waveguide characteristics to steer the array beam.

Although the disclosed embodiments are well suited for electronic beam-steered arrays, the broadband/multiband circular array antenna is readily applicable to various antenna types such as reciprocating beam antennas, fixed beam antennas, among others. The technique is amenable to a range of frequencies above UHF, where the wave nature of the antenna system predominates, as well as a range of frequencies below UHF, where a circuit type embodiment may be adequate.

BRIEF DESCRIPTION OF THE DRAWINGS

The present broadband/multiband directional antenna, as defined in the claims, can be better understood with reference to the following drawings. The components within the drawings are not necessarily to scale relative to each other; emphasis instead is placed upon clearly illustrating the principles of the antenna beam-steering and the related methods.

DETAILED DESCRIPTION

The present broadband/multiband directional antenna is described in further detail below. One embodiment is a small low-profile broadband/multiband circular array having an electronically steered directional beam for omnidirectional coverage. The array comprises a single driven broadband/multiband traveling-wave antenna element and multiple controlled surface-waveguide elements, which are symmetrically positioned around and adjacent to the driven element on an essentially circular circumference centered at the driven element. The array elements are located on a ground plane, which is, in general a reactive surface but can be an electrically conductive surface. The single driven element is connected via a feed network to a receiver and/or a transmitter. The driven element is a broadband/multiband traveling-wave antenna having an omnidirectional pattern, and preferably is also small and has a low profile, such as a mode-0 slow-wave antenna or a spiral-mode microstrip antenna.

Each surface-waveguide element is connected to, and controlled by, a switching circuit. Each surface-waveguide element presents two possible filtering states to the traveling wave: to pass or to reflect the incoming traveling wave. The RF (radio frequency) signal is isolated from the control circuit by low-pass filters. Switches, such as PIN diodes, are used to enable the surface waveguides to be electrically connected or disconnected to the ground plane, thus yielding binary states of filtering action. The switching circuit is generally on a microstrip or stripline circuit board enclosed by a box of conducting surfaces with shorting pins for suppression of RF leakage and higher-order modes. The switching circuit is connected to and controlled by an array beam steering computer.

The array provides a directionally controllable antenna beam with broadband/multiband frequency performance in a low-profile design that is both practical and economical to produce and maintain.

Although the disclosed embodiments are primarily suited for electronic beam-steered arrays, the broadband/multiband circular array antenna is readily applicable to fixed beam arrays, in which case fixed surface waveguides of much simpler configuration can be used. Note that none of the control circuits, etc., are needed for a fixed beam array antenna. The technique is amenable to frequencies above UHF, where the wave nature of the antenna system predominates, as well as at lower frequencies where a circuit type embodiment may be adequate.

A Broadband/Multiband Circular Array Antenna

Figure 1:
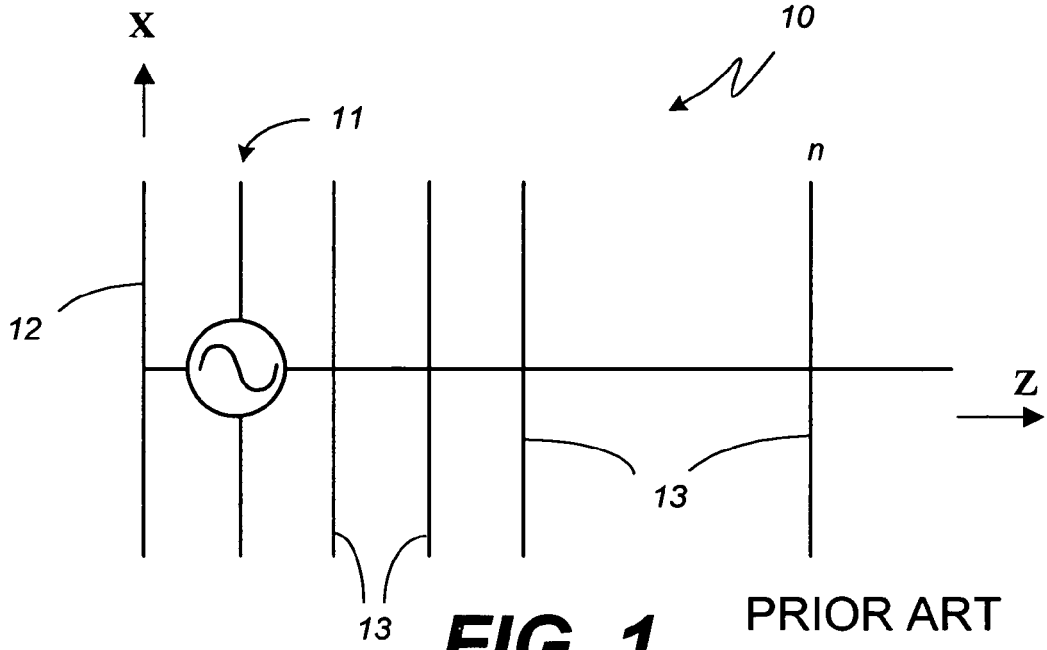
FIG. 1 PRIOR ART
FIG. 1 is a perspective view of a prior-art linear Yagi-Uda array.
Figure 2:
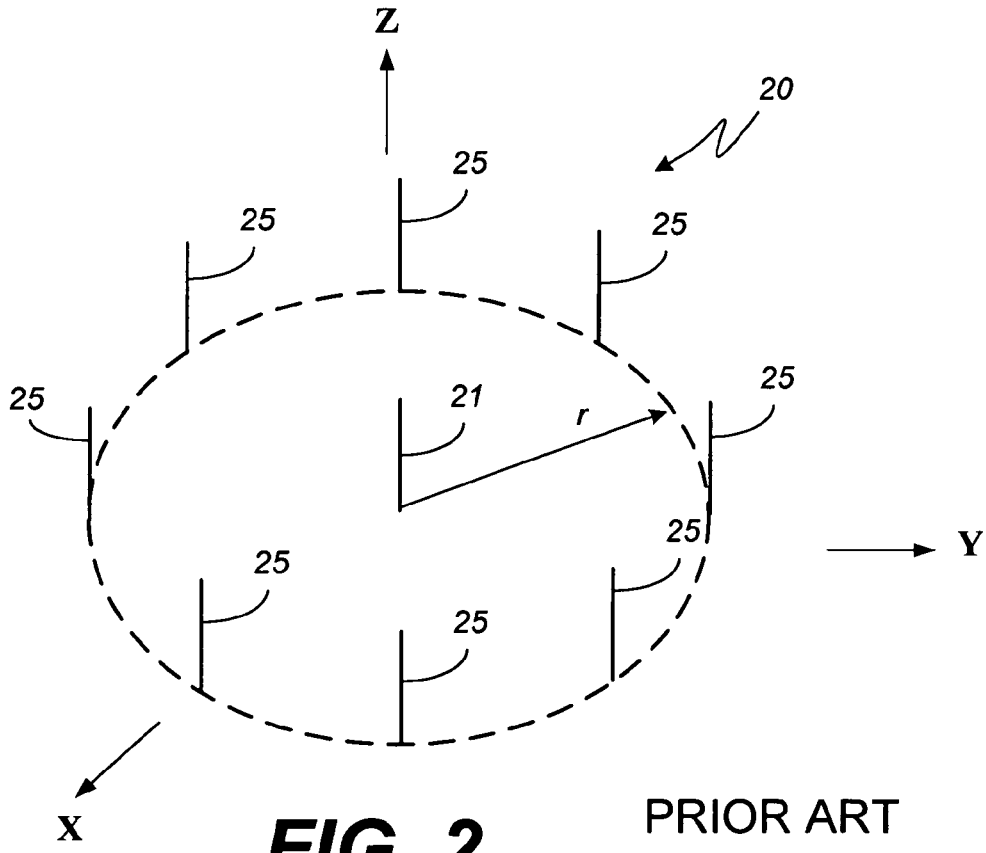
FIG. 2 PRIOR ART
FIG. 2 is a perspective view of a prior-art circular Yagi-Uda array with a single driven element.
Figure 3:
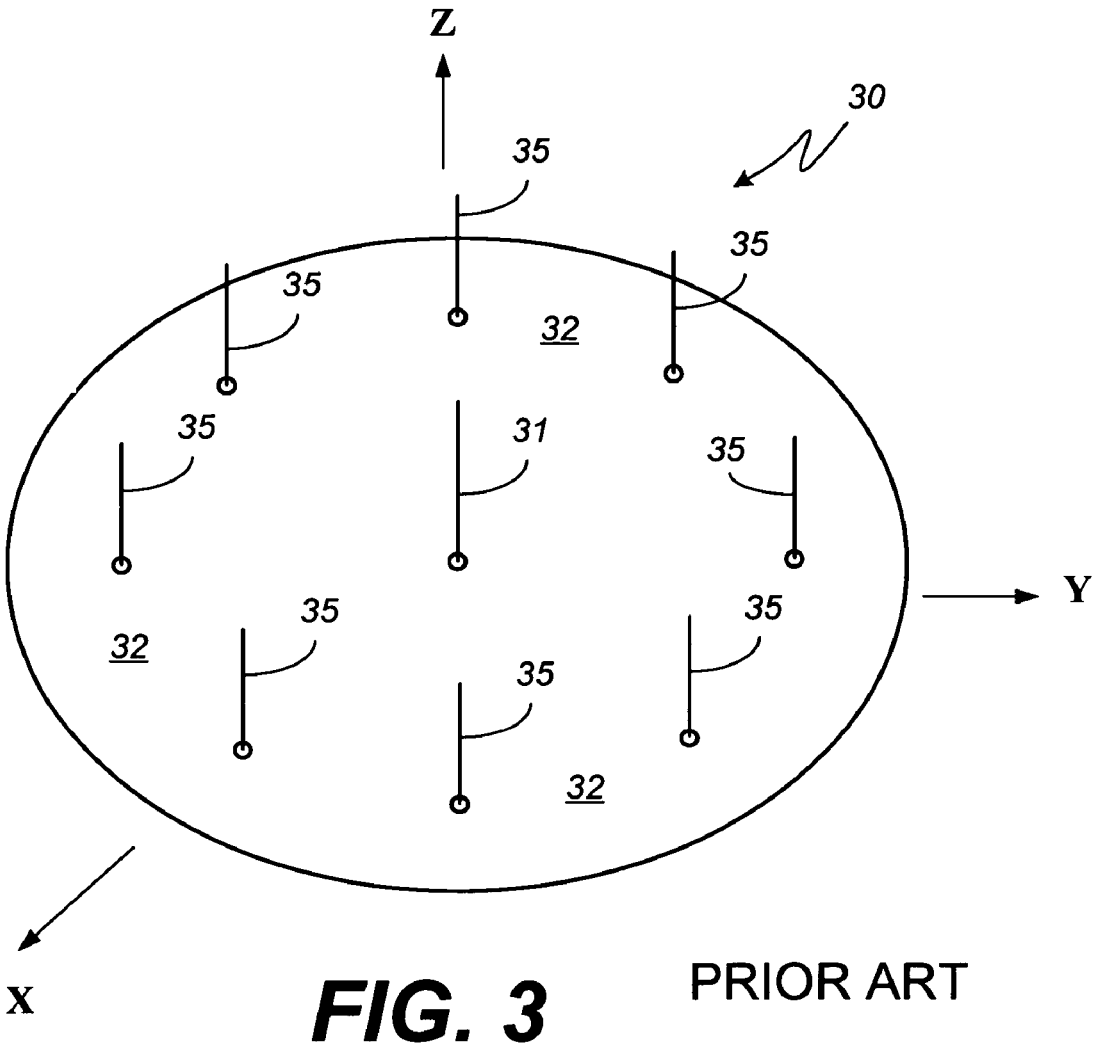
FIG. 3 PRIOR ART
FIG. 3 is a perspective view of a prior-art circular array of monopole elements on a ground plane with a single driven element.
Figure 4A:
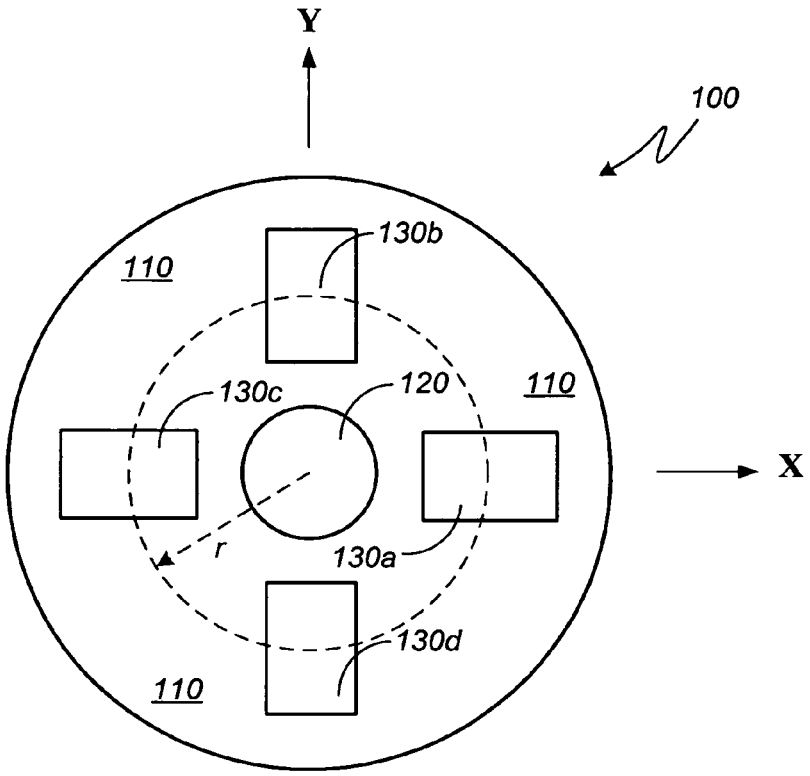
FIGS. 4A and 4B are, respectively, a top view and a side cross-sectional view of an embodiment of a small low-profile broadband/multiband circular array antenna.
Figure 4B:
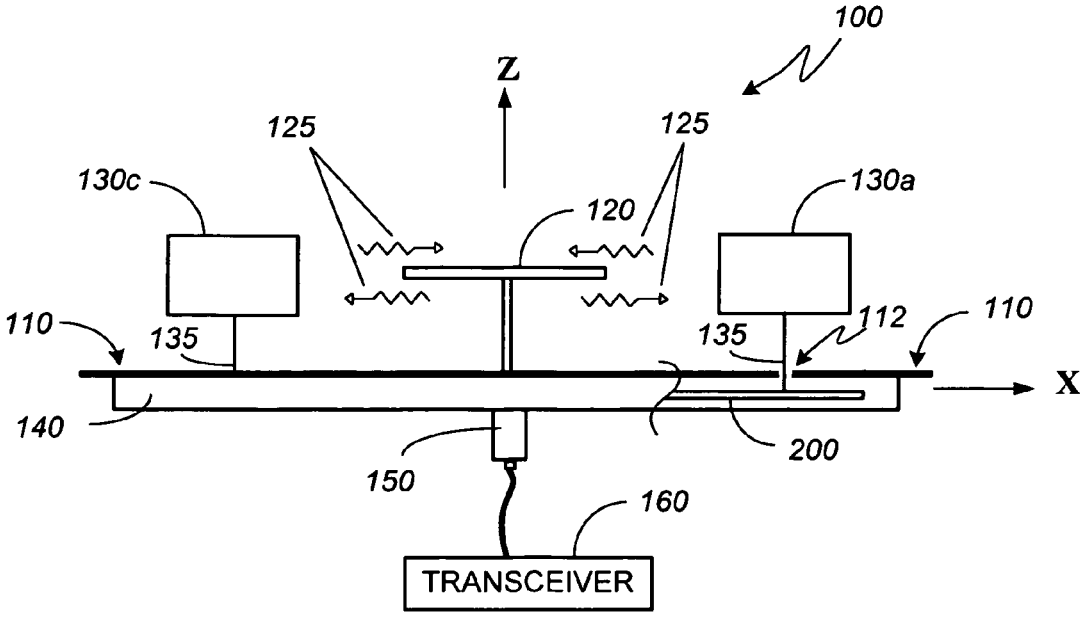

FIGS. 4A and 4B show, respectively, a top plan view and a front plan view for an embodiment of a small low-profile broadband/multiband circular array 100 embodying the principles of the present directional antenna. The array 100 comprises a single driven element 120 in the center and multiple controlled surface-waveguide elements 130, such as 130*a*, 130*b*, 130*c*, and 130*d*, on an essentially circular circumference. Surface-waveguide elements 130*a*, 130*b*, 130*c*, and 130*d* are positioned adjacent to ground plane 110, which is in general a reactive surface (to be discussed later) but can be an electrically conducting surface that is essentially planar and symmetrical about the Z-axis. As shown in FIG. 4B, the single driven element 120 is connected via feed network 150 to a transceiver 160. In alternative embodiments (not shown), a receiver or a transmitter may replace the transceiver 160.

The driven element 120 centered at the Z-axis is a broadband/multiband traveling-wave antenna, which produces an omnidirectional radiation pattern about the Z-axis. Preferably, the broadband/multiband driven element 120 is also small and has a low profile along the Z-axis, such as a mode-0 slow-wave antenna (J. J. H. Wang and J. K. Tillery, "Broadband Miniaturized Slow-Wave Antenna," U.S. Pat. No. 6,137,453, Oct. 24, 2000) or a spiral-mode microstrip antenna (J. J. H. Wang and V. K. Tripp, "Multioctave Microstrip Antenna," U.S. Pat. No. 5,313,216, May 17, 1994).

The surface-waveguide elements 130 are positioned symmetrically on an essentially circular circumference, and are adjacent and close to the driven element 120. Although only four surface waveguides 130*a*, 130*b*, 130*c*, and 130*d* are shown, a larger number of surface waveguides can be used to obtain more beams and/or narrower beams as may be desired. The driven element 120 is made as small as possible. However, the low-profile and broadband/multiband requirements, constrained by the present state of the art, dictate that the diameter of an enclosure surrounding the driven element 120 is likely to be larger than $\lambda/8$ at the low end of the operating frequencies.

Without loss of generality, the theory of operation can be explained by considering the case of transmit; the case of receive is similar on the basis of reciprocity. Referring to FIGS. 4A and 4B, the traveling wave 125 is emitted radially outward from the center of the driven element 120, which is a traveling wave antenna. The surface waveguides 130*a* through 130*d* each present, as a filter, two possible states to traveling wave 125. A first filter state passes the traveling wave 125. A second filter state reflects the traveling wave 125. In the embodiment illustrated in FIG. 4B, a beam would be radiated in the direction of the X-axis if the surface-waveguide elements 130*a* and 130*c* are in the first and second filter states, respectively (i.e., surface-waveguide element 130*a* passes and surface-waveguide element 130*c* reflects the incident traveling wave 125, respectively). Surface-waveguide elements 130*b* and 130*d*, which are removed from the side plan view of FIG. 4B to reveal driven element 120 and traveling waves 125, can be in either the pass or the reject state, but should be of an identical state to ensure symmetry of the beam.

A switching circuit 200 controls the state of each surface waveguide filter. Switching circuit 200 is substantially surrounded by enclosure 140, which is generally placed adjacent to the ground plane 110. Switching circuit 200 is connected with each surface-waveguide element 130 by conducting wires 135 passing through via holes 112 within the ground plane 110. Each of the conducting wires 135 is electrically isolated from ground plane 110. Feed network 150, which couples driven element 120 to transceiver 160, is generally a balun, which transforms the impedance and transmission mode of driven element 120 to match those of transceiver 160. Surface traveling waves 125, while supported on a reactive ground plane 110 in the described embodiment, can also be supported on a purely conducting and essentially planar surface.

Figure 5:
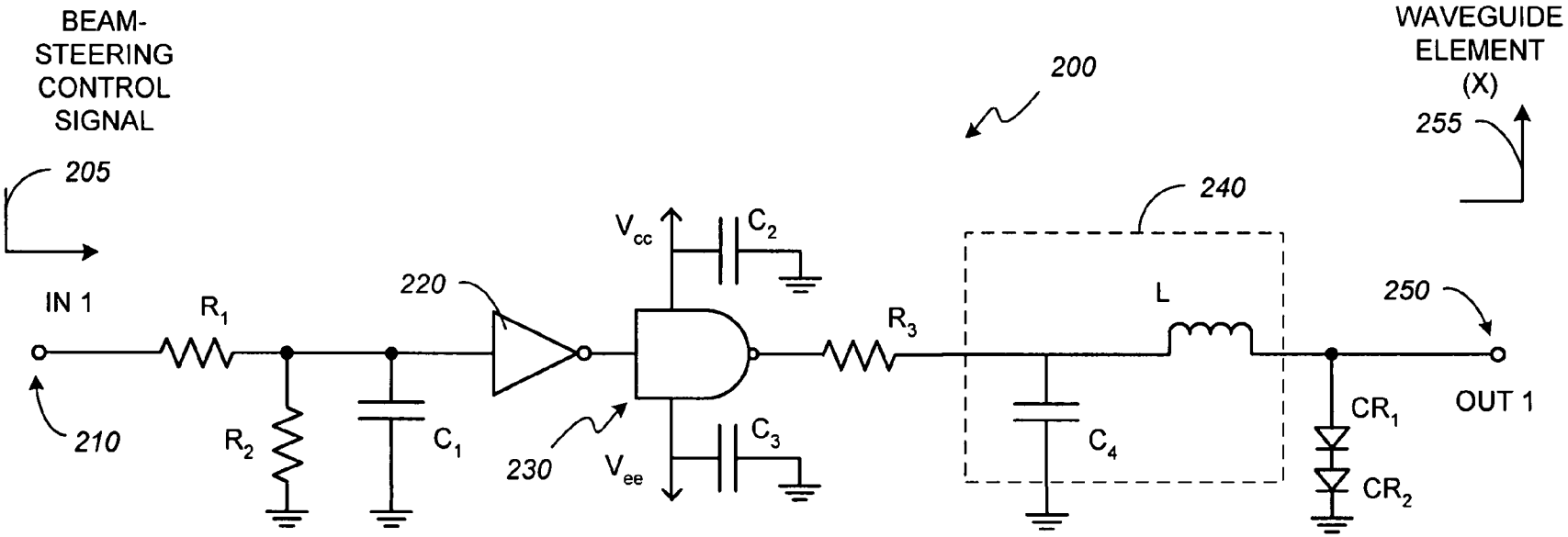
FIG. 5 is a schematic diagram showing an embodiment of a switching circuit that provides a control signal for a surface-waveguide element of the broadband/multiband circular array antenna of FIGS. 4A and 4B.

FIG. 5 shows schematically an embodiment of an individual switching circuit 200, one of which is connected to each respective surface-waveguide element 130*a* through 130*d* (FIGS. 4A and 4B) via conducting wires 135 (FIGS. 4A and 4B). Four such switching circuits 200, one for each surface-waveguide element 130, are supplied. A control signal 205 processed by switching circuit 200 and applied at output terminal 250, which is connected to conducting wire 135, determines the filtering state of a corresponding surface-waveguide element 130. Control signal 205 is provided by an array beam-steering computer or some other suitably configured beam-steering mechanism, and is coupled to the switching circuit 200 at input terminal 210. In the embodiment illustrated in FIG. 5, control signal 205 is current limited by resistor $R_1$ and filtered by the parallel combination of $R_2$ and $C_1$ before being passed to buffer 220. Buffer 220 amplifies control signal 205 before forwarding the control signal 205 to bipolar driver 230. The output of bipolar driver 230 is coupled to low-pass filter 240 via current limiting resistor $R_3$. Bipolar driver 230, by way of bias voltages Vcc and Vee, controllably turns on or off series connected PIN diodes $CR_1$ and $CR_2$ coupled between the output of low-pass filter 240 and ground.

A RF signal received by or transmitted from transceiver 160 (FIG. 4B) is isolated from the switching circuit 200 by low-pass filter 240, which includes capacitor $C_4$ and inductor L. Output signal 255 controllably connects or disconnects a corresponding surface-waveguide element 130 coupled to output terminal 250 with the ground plane 110 (FIG. 4). When a respective surface-waveguide element 130 is electrically isolated from the ground plane 110, an incident omnidirectional traveling wave 125 is generally not affected and passes through it. When a respective surface-waveguide element 130 is electrically coupled to the ground plane 110, an incident traveling wave 125 is generally reflected by the surface-waveguide element 130. In practice, each surface-waveguide element 130 has both transmission and reflection properties, which are expressed by its complex reflection coefficient. Generally, a surface waveguide is considered to pass a wave if its predominant feature is transmission rather than reflection. In addition, there are mutual electromagnetic couplings between the driven element 120 and the surface-waveguide elements 130. Thus, a directional beam results from the combined effects of these interactions.

To generate a beam in a particular direction, there are a number of filtering states that can accomplish it. In the case of the configuration of FIGS. 4A and 4B having four surface-waveguide elements 130, a total of 8 beams can be generated. For each beam there is more than one feasible filtering states, which have the general directionality but exhibit different features in terms of back lobe and other pattern variations.

For example, let us consider the case of transmit and designate two states, S and O, for each of the surface-waveguide elements 130, that is, 130*a*, 130*b*, 130*c*, and 130*d*. Filter state S passes the traversing traveling wave 125 from driven element 120. Filter state O reflects the traversing traveling wave 125 from driven element 120. To generate a beam directed along the X-axis over a desired frequency band in the operating frequency range of the array 100, surface-waveguide elements 130*a*, 130*b*, 130*c*, and 130*d* can have the following two states (1) S, O, O, O; (2) S, S, O, S; respectively. If the broadband/multiband circular array 100 has more surface-waveguide elements 130 than the four shown in FIG. 4A, for each beam there will be more possible combinations of filtering states.

Figure 6:
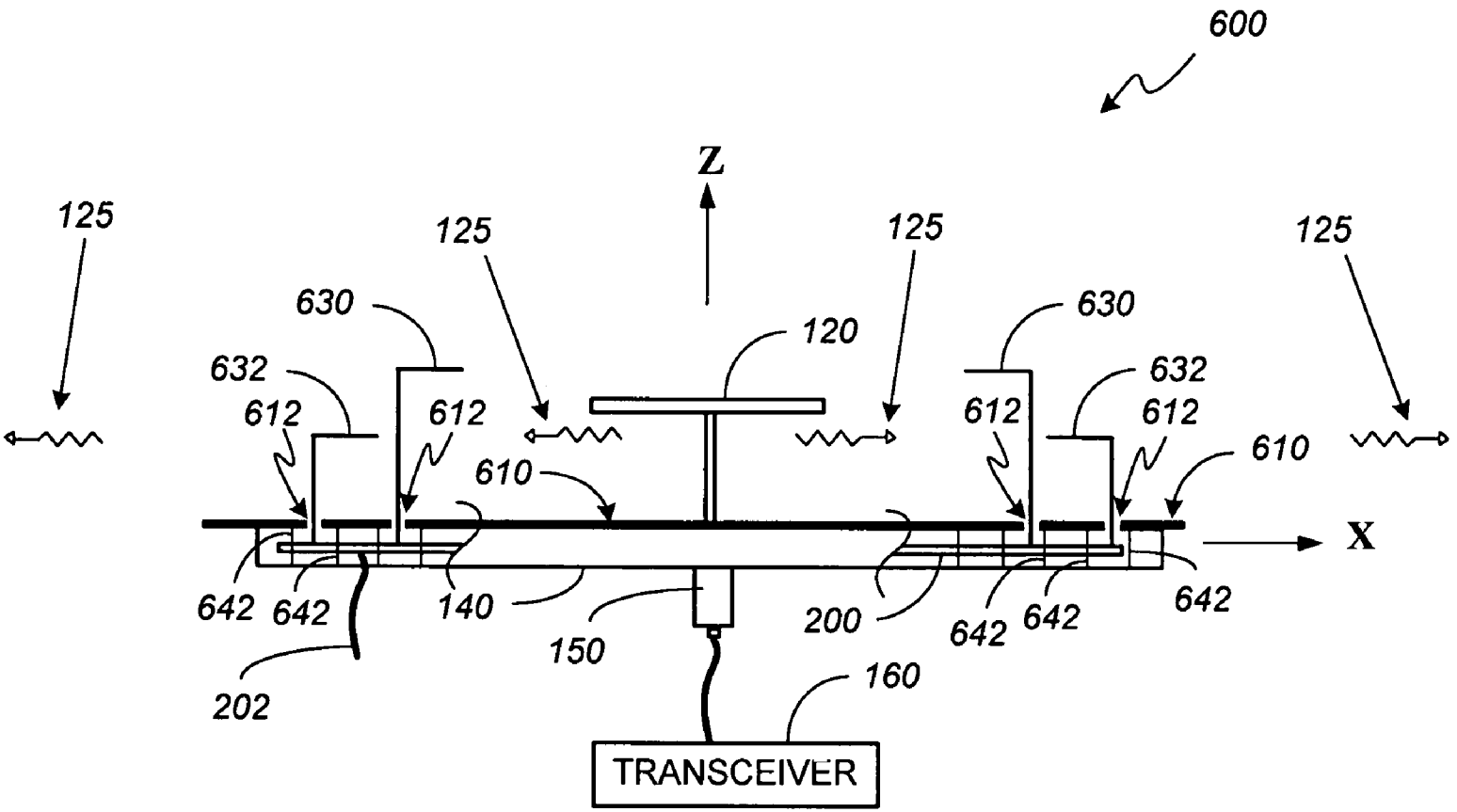
FIG. 6 is a side plan view with portions of an enclosure cut-away to reveal elements of an embodiment of a broadband/multiband circular array antenna.

FIG. 6 is a front plan view of a broadband/multiband circular array 600 with transmission-line antennas 630, 632 serving as surface-waveguide elements. The array 600 comprises a single driven traveling-wave element antenna 120 in the center and multiple controlled transmission-line antennas 630, 632 arranged along two substantially circular concentric circumferences similar to the single circumference arrangement in the top view in FIG. 4A. Transmission-line antennas 630, 632 are positioned adjacent to ground plane 610, which is in general a reactive surface or an electrically conducting surface that is essentially planar and symmetrical about the Z-axis. As shown in FIG. 6, the single driven element 120 is connected via feed network 150 to a transceiver 160. In alternative embodiments (not shown), a receiver or a transmitter may replace the transceiver 160. The driven element 120 centered at the Z-axis is a broadband/multiband traveling-wave antenna, which produces an omnidirectional radiation pattern about the Z-axis.

The transmission-line antennas 630, 632 are positioned symmetrically on two essentially circular concentric circumferences, and are adjacent and close to the driven element 120. The driven element 120 is made as small as possible. However, the low-profile and broadband/multiband requirements, constrained by the present state of the art, dictate that the diameter of an enclosure surrounding the driven element 120 is likely to be larger than $\lambda/8$ even at the low end of the operating frequencies.

Without loss of generality, the theory of operation can be explained by considering the case of transmit; the case of receive is similar on the basis of reciprocity. The traveling wave 125 is emitted radially outward from the center of the driven element 120, which is a traveling wave antenna. The transmission-line antennas 630, 632 each present, as a filter, two possible states to an incident traveling wave 125. A first filter state passes the traversing traveling wave 125. A second filter state reflects the traversing traveling wave 125.

The state of each surface waveguide filter is controlled by a switching circuit 200 surrounded by conducting enclosure 140, which is generally placed adjacent to ground plane 610. Enclosure 140 substantially surrounds switching circuit 200, except for the vias 612 similar to those for the ground plane 610, which serve to pass the wires connecting surface waveguides 630, 632 and control circuit 200, to prevent undesired RF coupling and interactions with array elements outside the enclosure 140. In the illustrated embodiment, enclosure 140 is a conducting box that includes the ground plane 610 if ground plane 610 is conducting. When the ground plane 610 is reactive enclosure 140 must have its own conducting enclosure rather than relying on the ground plane 610. Switching circuit 200, which can be implemented on a microstrip or stripline circuit board, is connected with each transmission line antenna 630, 632. Switching circuit 200 receives beam-steering control signals via cable 202. The control wires for the transmission-line antennas 630, 632 pass through via holes 612 within the ground plane 610.

In addition to showing how the transmission-line antennas 630, 632 are connected to switching circuit 200, the removed portions of enclosure 140 reveal mode suppressors 642 within enclosure 140 that surround switching circuit 200. Mode suppressors 642 are generally placed around the switching circuit 200 to ensure that higher-order modes are suppressed and evanescent, and thus the RF energy inside enclosure 140 propagates in the dominant mode on the transmission lines in the circuit board. Mode suppressors 642 can be a group of conducting pins, as shown in FIG. 6, connecting the ground plane 610 to the lower inner surface of the enclosure 140. The conducting pins should enclose the switching circuit 200 with sufficient density. Specifically, the distance between adjacent pins should be less than $\frac{1}{4}\lambda$ at the highest operating frequency of the broadband/multiband circular array 600. In addition, the volume enclosed by the mode-suppressing conducting pins should be small enough to suppress cavity resonance. Accordingly, RF disturbances, should they occur, will be local and evanescent.

Figure 7A:
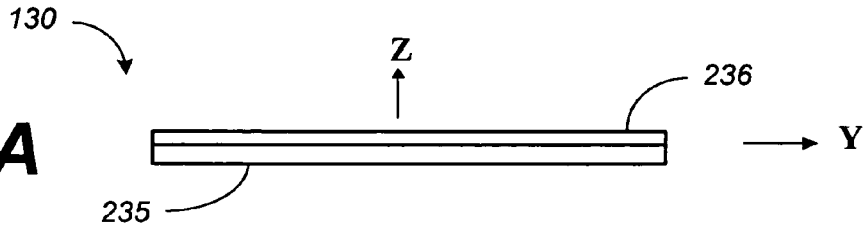
FIGS. 7A–7D are drawings showing four embodiments of surface waveguides.

The broadband/multiband feature of the surface waveguides is rooted in the physics of the surface wave, which can be supported on a generally planar and preferably reactive surface. FIGS. 7A through 7D show multiple tunable surface waveguide arrangements. FIG. 7A shows a surface-waveguide element 130 consisting of a dielectric layer 236 on top of a conducting surface 235. By judiciously varying the distributive dielectric constant of the dielectric layer 236, the impedance property of the surface waveguide can be varied to control the directional property of the wave and thus the radiation pattern.

Figure 7B:
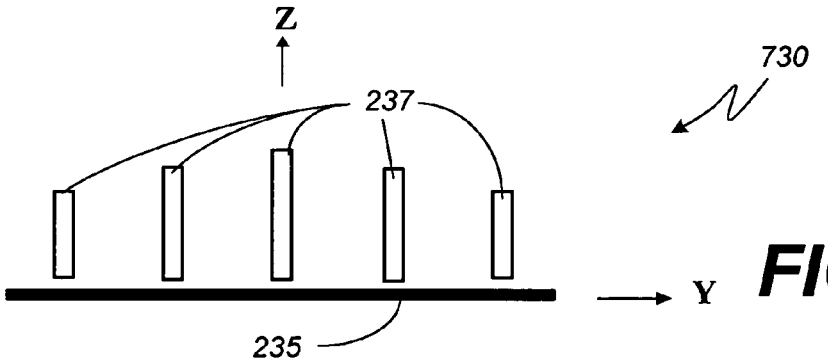

FIG. 7B shows another example of surface-waveguide arrangement 730 consisting of a set of conducting plates, rods, or corrugated structures 237 adjacent to conducting surface 235. The choice of the thickness of the conducting plates, the diameter of the rods, their heights and relative spacing, etc., of the corrugated structures within the set 237 is governed by the well established theory and practices on surface waveguides as will be discussed under a latter section entitled "Theory." The complex transmission and reflection property of the surface-waveguide 730 can be individually tuned and controlled by varying the impedances at the gaps (at the vias of the ground plane 235) between the corrugated structures 237 and the conducting surface 235. In addition to tuning the elements of set 237 at the gaps, the relative height, spacing, and position of the elements of set 237 can also control the directional property in elevation of a traveling wave incident upon the elements of the 237 so that the beam peak can be made closer to or further from the horizontal plane (the X-Y plane).

Figure 7C:
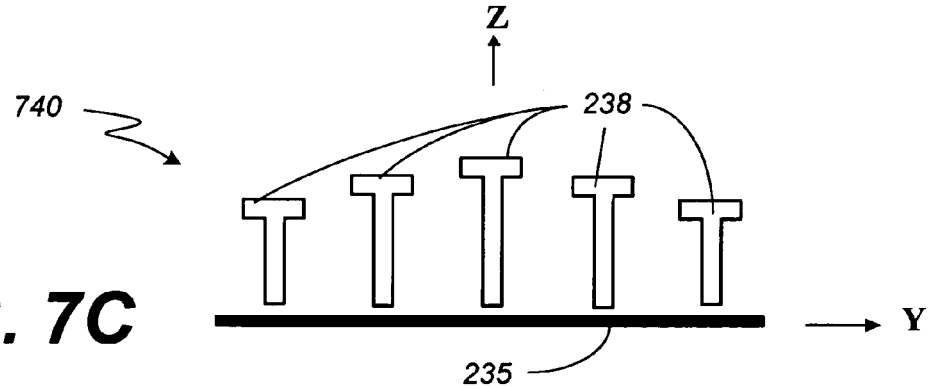

FIG. 7C shows a second example of a surface-waveguide arrangement 740 consisting of another set of conducting plates, rods, or corrugated structures 238 adjacent to conducting surface 235. The theory, function, and operation of set 238 and surface-waveguide arrangement 740 are similar to those for set 237 and surface-waveguide arrangement 730. As described above regarding set 237 (FIG. 7B), the conducting plates, rods, or corrugated structures within set 238 can be individually tuned. In addition to the design flexibility offered by controlling the impedance of individual elements of set 238, the relative height, spacing, and position of the elements of set 238 can be adjusted to further control the directional property of a traveling wave incident upon set 238.

Figure 7D:
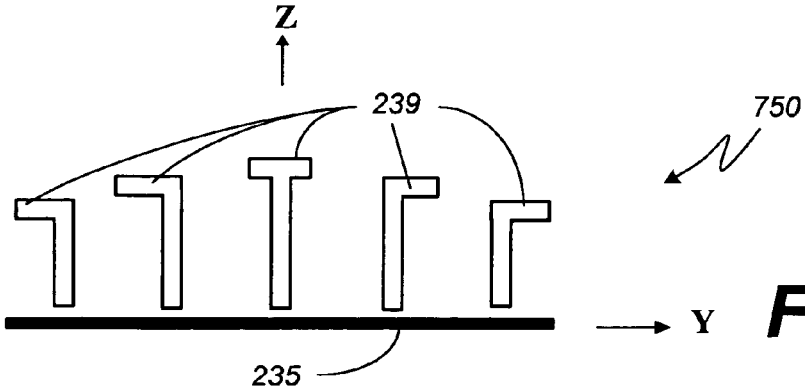

FIG. 7D shows a third example of a surface-waveguide arrangement 750 consisting of a third set of conducting plates, rods, or corrugated structures 239 adjacent to conducting surface 235. The theory, function, and operation of set 239 and surface-waveguide arrangement 750 are also similar to those for set 237 and surface waveguide arrangement 730. As with sets 237, 238 above (FIGS. 7B and 7C), each of the conducting plates, rods, or corrugated structures within set 239 can be individually tuned. In addition, the relative height, spacing, and position of the elements of set 239 can be adjusted to control the directional property of a traveling wave incident upon set 239.

The choice for the thickness of the plates or the diameter of the rods, as well as their heights and the spacing between adjacent elements, in each of the example arrangements 730, 740, and 750 illustrated in FIGS. 7B through 7D is determined using theory described and referenced in the next section entitled "Theory." While the illustrated embodiments include symmetrically arranged and evenly spaced elements within sets 237, 238, and 239, respectively, other embodiments are also implied for use in the broadband/multiband circular array antenna.

A switch corresponding to each surface-waveguide element 130, 630, 632 (e.g., sets 237, 238, 239 of conducting plates, rods, or corrugated structures, such as transmission line antennas) bridges or leaves open the gap electrically to offer two states of filtering corresponding to each surface-waveguide element to incident traveling waves 125. Practical implementation of the binary states controlled by the switching circuit 200 in the case of the surface waveguide has been discussed earlier by way of FIGS. 5 and 6.

Theory

The present circular-array antenna is based on the concept of radial traveling-wave arrays and takes advantage of the inherent broadband nature of surface wave propagation by using surface waveguides that have broadband binary filtering capability electronically controlled by switches, such as PIN diodes and/or MEMS (micromachined electromechanical system) switches.

Without loss of generality, the theory of operation can be explained by considering the case of transmit; the case of receive is similar on the basis of reciprocity. Referring to FIGS. 4A and 4B, the traveling wave 125 is emitted radially outward from the center of the driven element 120, which is a traveling wave antenna. In order to generate omnidirectional RF radiation near the surface of the ground plane 110 and to achieve broadband/multiband operation, the launched traveling wave 125 is preferably a surface wave propagating along, and intimately bound to, the ground plane 110, as well as the surface-waveguide elements 130. The four surface-waveguide elements 130 (130*a*, 130*b*, 130*c*, and 130*d*) serve as binary filters, which pass or reflect the incident traveling wave 125 as commanded by respective switching circuits 200 (FIG. 5). Discussions on traveling-wave antennas, traveling-wave structures, reactive surfaces, and surface waveguides can be found in the following textbooks: C. H. Walter, *Traveling Wave Antennas*, McGraw-Hill, New York, N.Y., 1965 and R. E. Collin, *Field Theory of Guided Waves*, second edition, IEEE Press, IEEE, New York, 1991.

The surface waveguide element sets 237, 238, 239 (FIGS. 7B through 7D), which can be viewed as an aggregate of transmission line antennas or a corrugated surface, are filters of the distributed type, versus filters made of lumped elements commonly employed at lower frequencies. Transmission line antennas are a section of the transmission line supporting the traveling surface wave. The broadband/multiband feature of these surface-waveguide elements is rooted in the physics of the surface wave, which can be supported on a generally planar and preferably reactive surface. A surface wave can also be supported on a purely conducting and essentially planar surface. Analysis of a surface wave along a plane interface leads to a TM (transverse magnetic) wave, which has a magnetic field perpendicular to the direction of propagation and parallel to the plane surface. The TM mode also has electric fields perpendicular to the plane surface and in the direction of propagation. The corrugated surface is a well-known surface waveguide for the TM surface wave. The corrugated surface waveguide can either pass or reject the surface wave, depending on whether it is connected or disconnected with the ground plane.

The surface waveguide can support a surface wave with no low-frequency cutoff, and has only a minimal number of discrete modes. Generally, and preferably, the traveling wave is a slow wave having a phase velocity less than that of light. The selection of the surface waveguide is based on the type of surface wave desired and the controllable binary-filtering feature possessed.

Although there are many forms of surface waveguides, the present broadband/multiband circular array antenna uses those with variable filtering functionality, which is controllable electronically. A dielectric-layered surface waveguide (FIG. 7A) is more difficult to switch or vary, therefore not easily or readily amenable to switching actions. On the other hand, conducting plates, rods, or corrugated structures in sets 237, 238, 239 in FIGS. 7B through 7D are spaced at a very small distance apart from the conducting surface 235. Thus, the surface-waveguide elements in FIGS. 7B through 7D have binary states dictated by shorting or opening the small gap with a device such as a diode, thereby connecting and disconnecting the separate conducting plates, rods, or corrugated structures across sets 237, 238, or 239 with the conducting surface 235. Theory for the surface-waveguide elements in FIGS. 7B through 7D predicts broadband filtering action in both states. Measurements also showed that the number of conducting plates or rods can be as few as one; like a single-section filter consisting of one section using a single inductor (L), capacitor (C) or an L-C section, consistent with filter theory (G. Matthaei, L. Young, and E. M. T. Jones, *Microwave Filters, Impedance-Matching Networks, and Coupling Structures*, McGraw-Hill, New York, 1964, reprinted by Artech House, Norwood, Mass. in 1980).

Although the structurally suspended configurations (between the individual elements of sets 237, 238, and 239 and conducting surface 235) illustrated in FIGS. 7B through 7D are feasible, a more practical embodiment, illustrated in FIG. 6, shows transmission-line antennas 630, 632 mechanically supported by the dielectric layer of the printed circuit board of the switching circuit 200. Suitably positioned switches such as a PIN diode or a MEMS switch controllably couple each respective transmission line antenna 630, 632 to ground plane 610.

Experimental Verification

Figure 8:
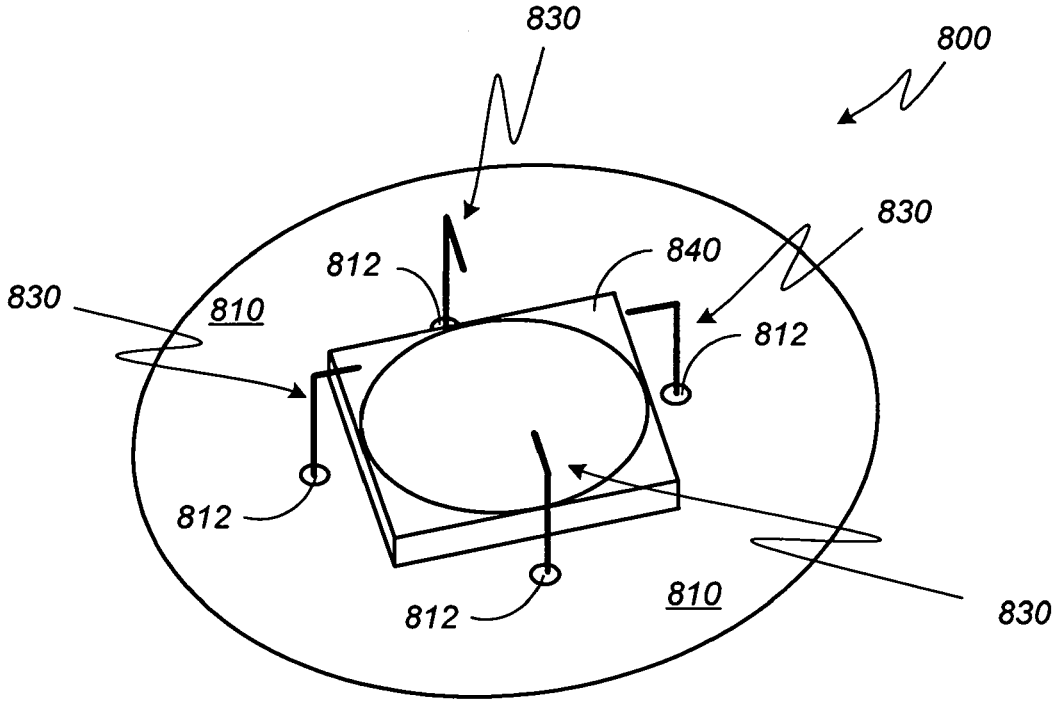
FIG. 8 is a perspective view of an embodiment of broadband/multiband circular array antenna.

Extensive experimentation has been performed successfully for this broadband/multiband circular array antenna. FIG. 8 is a perspective view of an embodiment of a model broadband/multiband omnidirectional circular array antenna 800. In FIG. 8, a square disk-shaped mode-0 slow-wave antenna, which is approximately 2.5-inch×2.5-inch square and approximately 0.75-inch tall, is used as the driven element 840. Transmission line antennas 830 are arranged concentrically about driven element 840 on ground plane 810. The ground plane 810 is conductive and simulates a mounting platform, such as the exterior surface of an airplane. Each of the transmission line antennas 830 extends through a respective via 812 in ground plane 810. The transmission line antennas 830, as illustrated and described above, are coupled to respective switching circuits 200 (FIG. 5) in an enclosure obstructed from view by ground plane 810.

Figure 9:
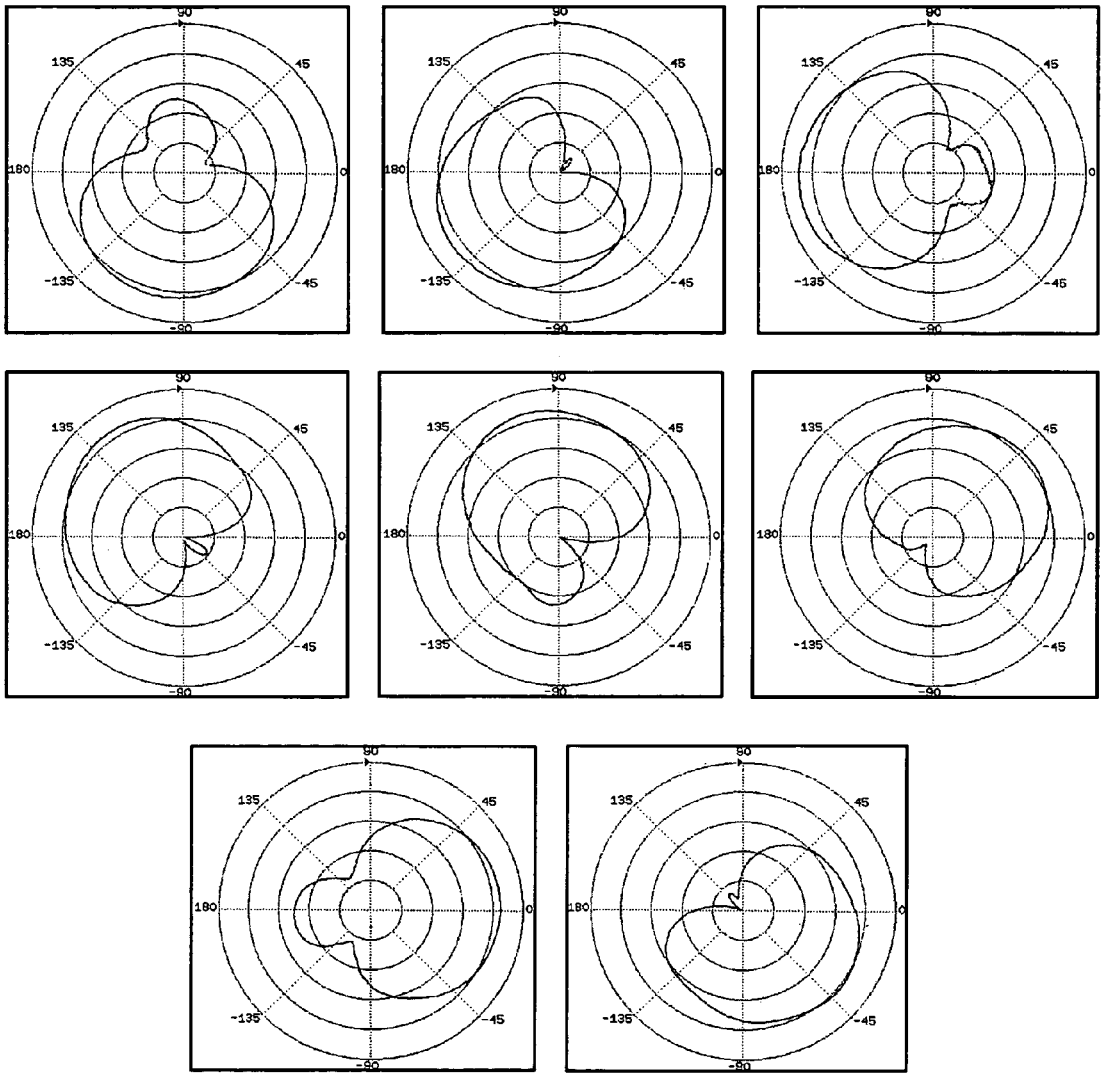
FIG. 9 is a set of measured azimuthal radiation patterns at 1.525 GHz showing beam steering in the azimuthal plane for the of broadband/multiband circular array antenna of FIG. 8.
Figure 10A:
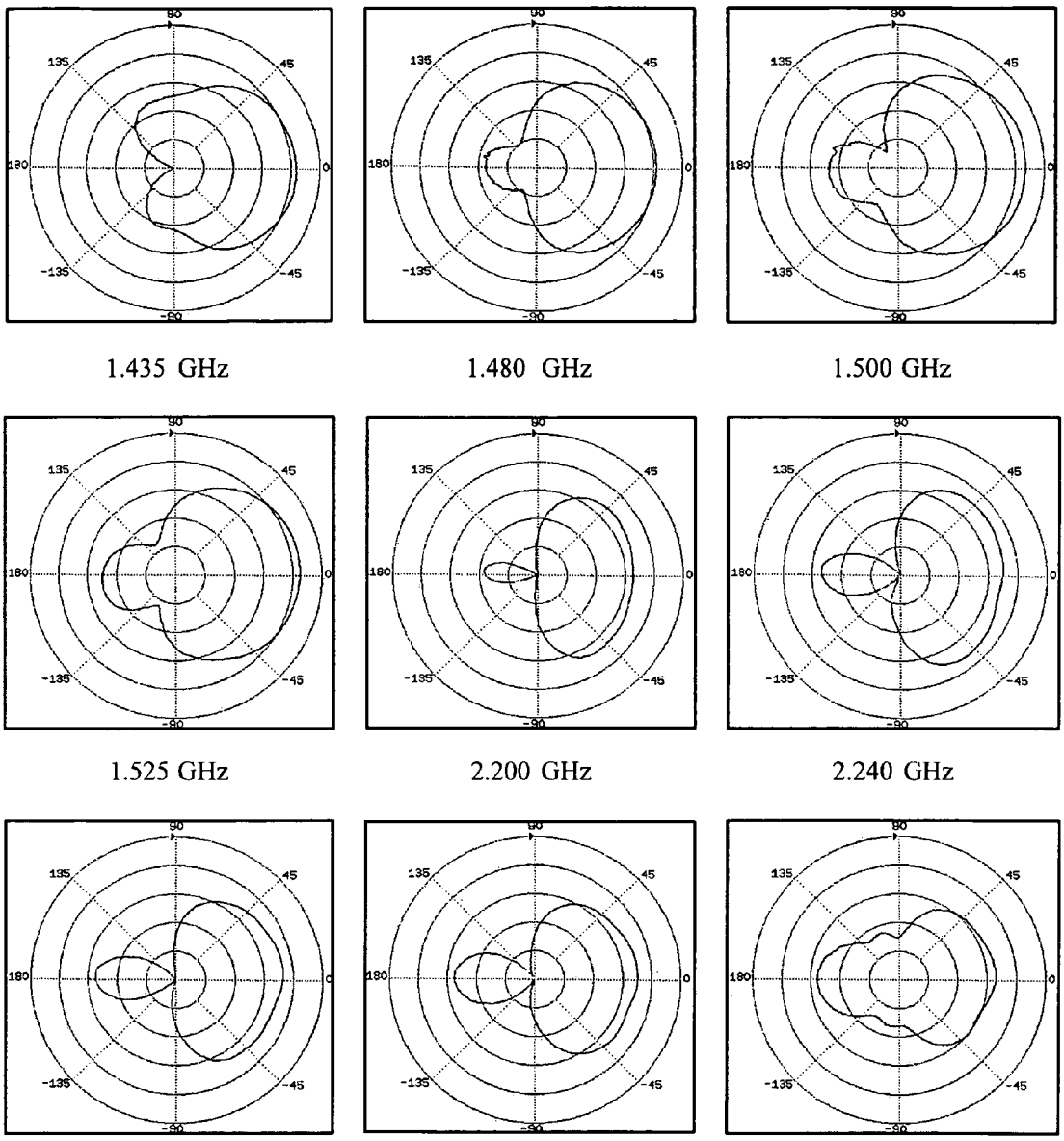
FIG. 10A is a set of measured azimuthal radiation patterns for the broadband/multiband circular array antenna of FIG. 8 showing beam steered to 0° at various frequencies in L and S bands.
Figure 10B:
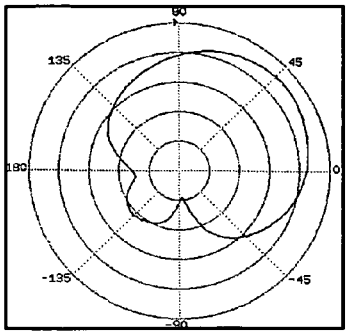
FIG. 10B is a set of measured azimuthal radiation patterns for the broadband/multiband circular array antenna of FIG. 8 showing beam steered to 45° at various frequencies in L and S bands.
Figure 10B:
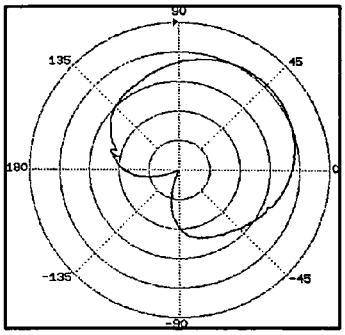
Figure 10B:
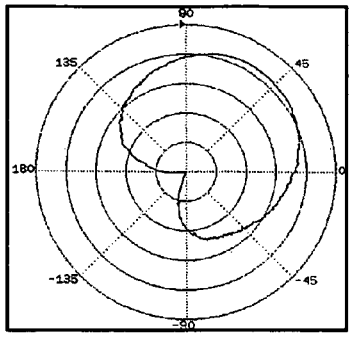
Figure 10B:
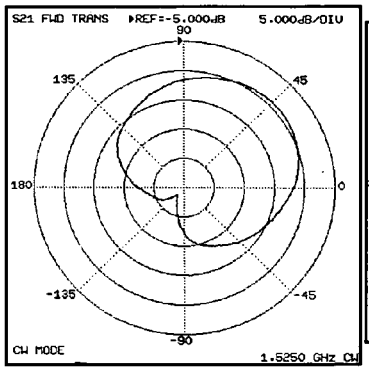
Figure 10B:
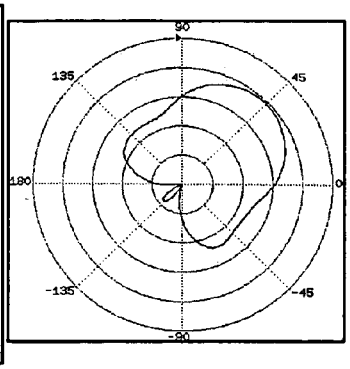
Figure 10B:
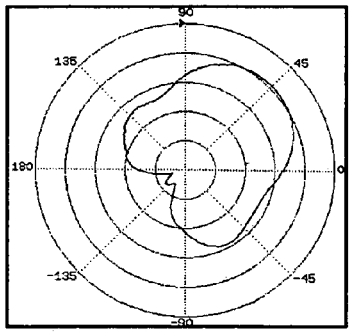
Figure 10B:
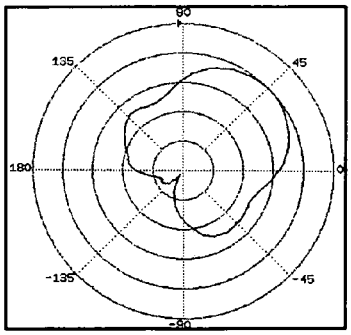
Figure 10B:
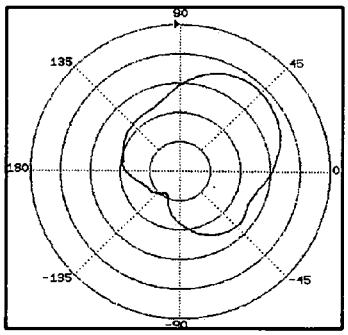
Figure 10B:
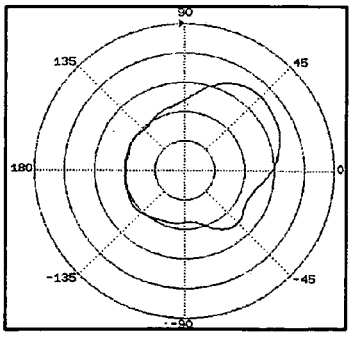

The capability of electronic beam steering of this antenna is shown in FIG. 9, which displays steered azimuthal patterns measured for the breadboard model of FIG. 8 at 1.525 GHz in an anechoic test chamber at Wang Electro-Opto Corporation. As can be seen, there are eight beams, which span the entire 360° for full azimuth coverage. The desired broadband and multiband performance of this circular array antenna 800 is demonstrated by the measured radiation patterns in FIGS. 10A and 10B. FIG. 10A shows measured azimuthal patterns for the model of FIG. 8 steered to 0° at various frequencies in the two operating frequency ranges, one in the L band and another in the S band. FIG. 10B shows similar broadband/multiband measured azimuthal patterns steered to 45°.

Variation and Alternative Forms of the Broadband/Multiband Circular Array Antenna Although four surface-waveguide elements 130 are shown in the FIGS. 4A, 4B, etc., any number of surface-waveguide elements 130 can be chosen.

Although only four switchable broadband/multiband surface waveguides are shown in FIGS. 7B through 7D, additional symmetrically positioned and concentrically arranged switchable broadband/multiband surface waveguide elements are also implied in this broadband/multiband circular array antenna.

Although PIN diodes are shown in FIG. 5, other switches such as a MEMS switch are also implied in this broadband/multiband circular array antenna.

If the desired angular range of beam scan is less than the full azimuth coverage of 360°, the antenna array may consist of surface-waveguide elements located along an arc equidistant from the driven traveling wave antenna whose omnidirectional pattern is narrowed accordingly. The angular span of the arc populated with surface-waveguide elements is similar to the range of beam steering in angular span.

Although the applications discussed have been for steered beams, the broadband/multiband circular array antenna is readily applicable to fixed-beam arrays. In the latter case, fixed surface waveguides of much simpler configuration can be used and the control circuits are removed.

What is claimed is:

1. A circular directional array antenna comprising:

a driven omnidirectional traveling-wave antenna element coupled to a transceiver via a feed network; and a plurality of surface-waveguide elements symmetrically positioned about and concentrically spaced from the driven omnidirectional traveling-wave antenna element, each surface-waveguide element configured to receive a control signal configured to alter a surface-waveguide transmission characteristic.

2. The circular directional array antenna of claim 1, further comprising:

a ground plane having a plurality of vias, wherein the driven element and the surface-waveguide elements are adjacent to the ground plane and connected to the transceiver and control signal, respectively, through the corresponding feed network and the vias.

3. The circular directional array antenna of claim 2, wherein the ground plane comprises a reactive surface.

4. The circular directional array antenna of claim 2, wherein the ground plane comprises a conductive surface.

5. The circular directional array antenna of claim 2, wherein the ground plane is finite and symmetrical about the driven element.

6. The circular directional array antenna of claim 2, wherein the driven omnidirectional traveling-wave antenna element generates an omnidirectional surface wave substantially parallel to the ground plane.

7. The circular directional array antenna of claim 2, wherein the ground plane comprises a reactive surface which modifies a shape of a radiation pattern in elevation with respect to the ground plane.

8. The circular directional array antenna of claim 1, wherein the driven omnidirectional traveling-wave antenna element comprises a mode-0 slow-wave antenna.

9. The circular directional array antenna of claim 1, wherein the driven omnidirectional traveling-wave antenna element comprises a mode-0 spiral-mode microstrip antenna.

10. The circular directional array antenna of claim 1, further comprising:

a switching circuit having a plurality of inputs and a corresponding plurality of outputs, the outputs independently responsive to a beam steering means coupled to the inputs, wherein a respective output is coupled to each of the surface-waveguide elements.

11. The circular directional antenna of claim 10, wherein the waveguide characteristic of each of the surface-waveguide elements is selectively controlled to pass or reflect a traveling wave.

12. The circular directional array antenna of claim 10, comprising:

a conducting enclosure configured to surround the switching circuit to suppress radio frequency leakage and electromagnetic coupling between the driven omnidirectional traveling-wave antenna element and the surface-waveguide elements through the control signal.

13. The circular directional array antenna of claim 12, wherein the conducting enclosure comprises mode suppressors arranged around the switching circuit with a distance between adjacent mode suppressors being less than $\lambda/4$, where $\lambda$ is the wavelength of the highest operating frequency.

14. A method for operating a broadband/multiband beam-steered circular array antenna, comprising:

locating a driven broadband/multiband traveling wave antenna element that generates an omnidirectional electromagnetic radiation pattern on a ground plane;

concentrically arranging a plurality of broadband/multiband surface-waveguide elements around the driven omnidirectional traveling-wave antenna; and applying control signals configured to steer the electromagnetic radiation by selectively altering waveguide characteristics of respective surface-waveguide elements that receive the control signals.

* * * * *